US009546466B2

(12) United States Patent
Wander

(10) Patent No.: US 9,546,466 B2
(45) Date of Patent: Jan. 17, 2017

(54) DISH FOR USE IN A MANHOLE

(71) Applicant: Utility Sealing Systems, Inc., Venice, FL (US)

(72) Inventor: Lloyd J. Wander, Venice, FL (US)

(73) Assignee: Utility Sealing Systems, Inc., Venice, FL (US)

( * ) Notice: Subject to any disclaimer, the term of this patent is extended or adjusted under 35 U.S.C. 154(b) by 83 days.

(21) Appl. No.: 14/597,705

(22) Filed: Jan. 15, 2015

(65) Prior Publication Data

US 2015/0197913 A1 Jul. 16, 2015

Related U.S. Application Data

(60) Provisional application No. 61/927,713, filed on Jan. 15, 2014.

(51) Int. Cl.
*E02D 29/14* (2006.01)
*E05F 15/60* (2015.01)

(52) U.S. Cl.
CPC ..... *E02D 29/1481* (2013.01); *E02D 29/14* (2013.01); *E02D 29/1472* (2013.01); *E02D 29/1427* (2013.01); *E05F 15/60* (2015.01)

(58) Field of Classification Search
CPC ..... E05F 15/60; G05B 19/00; G06F 1/1613; G06F 1/1632; G08B 13/149; G08B 17/10; G08B 21/20; G08B 25/08; G08B 29/14; E03F 7/00; G01F 15/063; E02D 29/1481; E02D 29/1472; E02D 29/14; H04B 1/034
USPC ..... 340/545.4, 632, 870.16, 539.16, 540, 340/612, 606, 539.26, 539.27
See application file for complete search history.

(56) References Cited

U.S. PATENT DOCUMENTS

| | | | | |
|---|---|---|---|---|
| 3,621,623 | A | 11/1971 | MacMillan Downes | |
| 3,920,347 | A | 11/1975 | Sauriol et al. | |
| 4,030,851 | A | 6/1977 | Graybeal | |
| RE29,636 | E | 5/1978 | Gilbu | |
| 4,649,674 | A | 3/1987 | Gaul et al. | |
| 4,650,365 | A | 3/1987 | Runnels | |
| 4,919,564 | A | 4/1990 | Neathery et al. | |
| 4,957,389 | A | 9/1990 | Neathery | |
| 5,062,735 | A | 11/1991 | Gaudin | |
| 5,382,113 | A | 1/1995 | Chilton et al. | |
| 5,727,351 | A | 3/1998 | Neathery et al. | |
| 5,733,444 | A | 3/1998 | Johnson | |
| 5,743,673 | A | 4/1998 | Bravo | |
| 5,827,007 | A | 10/1998 | Barton et al. | |
| 5,951,200 | A | 9/1999 | Barton | |
| 5,957,618 | A | 9/1999 | Sims et al. | |
| 5,966,876 | A | 10/1999 | Neathery et al. | |
| 6,007,270 | A | 12/1999 | Bowman | |
| 6,161,984 | A | 12/2000 | Sinclair | |
| 6,179,518 | B1 | 1/2001 | Suatac | |
| 6,244,292 | B1 | 6/2001 | Antunez | |
| 6,254,770 | B1 | 7/2001 | Remon | |
| 6,402,031 | B1 * | 6/2002 | Hall | G05B 19/00 235/400 |

(Continued)

*Primary Examiner* — Ali Neyzari
(74) *Attorney, Agent, or Firm* — Dinsmore & Shohl LLP

(57) ABSTRACT

A dish for use in a manhole having a manhole cover covering a manhole opening and a frequency transmitting system for use in a manhole are provided. The dish and the frequency transmitting system is configured to transmit a signal to a network through the manhole cover. The signal is generated by a sensor unit disposed within the manhole and configured to detect the conditions of the manhole.

10 Claims, 3 Drawing Sheets

(56) References Cited

U.S. PATENT DOCUMENTS

| | | | | |
|---|---|---|---|---|
| 6,464,425 | B1 | 10/2002 | Closkey | |
| 6,986,226 | B2 | 1/2006 | Banks | |
| 7,002,481 | B1 * | 2/2006 | Crane | G08B 29/14<br>324/207.2 |
| 7,292,143 | B2 | 11/2007 | Drake et al. | |
| 7,342,504 | B2 | 3/2008 | Crane et al. | |
| 7,540,953 | B2 | 6/2009 | Fitzgerald | |
| 7,626,508 | B2 | 12/2009 | Kosuge et al. | |
| 7,701,356 | B2 | 4/2010 | Curt et al. | |
| 7,748,927 | B2 | 7/2010 | Neathery | |
| 7,768,413 | B2 | 8/2010 | Kosuge et al. | |
| 7,798,742 | B2 | 9/2010 | Nolle et al. | |
| 7,883,290 | B1 | 2/2011 | Ross et al. | |
| 7,889,079 | B2 * | 2/2011 | Albahri | G08B 13/08<br>116/12 |
| 8,025,079 | B2 | 9/2011 | Wander | |
| 8,237,576 | B2 | 8/2012 | Wander | |
| 8,425,145 | B2 | 4/2013 | Lawrence | |
| 9,127,431 | B2 * | 9/2015 | Lanham | E05F 15/60 |
| 2005/0103694 | A1 | 5/2005 | Rost et al. | |
| 2007/0223997 | A1 | 9/2007 | Fuchs et al. | |

* cited by examiner

DISH FOR USE IN A MANHOLE

CROSS-REFERENCE TO RELATED APPLICATIONS

This application claims priority of U.S. Provisional Application No. 61/927,713 filed Jan. 15, 2014, the contents of which are incorporated herein by reference.

FIELD OF THE INVENTION

Disclosed herein is a dish for use in a manhole opening. The dish is configured to transmit a signal generated by sensors disposed underneath the manhole cover out of the manhole so as to facilitate the transmission of information relating to the condition of the manhole.

BACKGROUND OF THE INVENTION

Modern cities operate in part using a maze of subterranean utility lines such as water, steam, and sewer lines. However, despite the importance of these utilities, the only device that typically stands between the person gaining access to a subterranean line or conduit is a simple iron or steel manhole cover. These manhole covers are dimensioned to fit within a manhole opening. However, they are generally smaller in diameter so as to allow a user to remove the manhole cover to gain access to the subterranean utility.

It is desirable to identify instances where unauthorized access to the subterranean utility has occurred or when volatile gas is present within the manhole. Proximity sensors and fume sensors may be used to detect such conditions. However, transmitting a signal out of the manhole is difficult as the manhole cover may become a barrier preventing a signal from reaching a carrier network. Accordingly, it remains desirable to have a dish configured to utilize the manhole cover to assist in transmitting a signal generated within the manhole, out of the manhole.

SUMMARY OF THE INVENTION

A dish for use in a manhole covered by a manhole cover is provided. The dish is seated within the manhole opening and is seated underneath the manhole cover. The dish includes a shell having a peripheral lip. The peripheral lip is suspended by a peripheral ledge of the manhole opening. A plurality of transmitting plates are disposed on the peripheral lip of the dish. The transmitting plates are configured to transmit a signal at a predetermined frequency.

The dish includes a ground out assembly configured to detect a ground out condition and direct a signal to a transmitting plate which is not grounded out. The ground out assembly includes a processor, a ground sensor, an input, and a wiring system. The wiring system electrically connects each of the plurality of transmitting plates to the input. The input is configured to receive an electrical signal from a sensor unit configured to detect the conditions of the manhole. The ground sensor detects if a transmitting plate is grounded. The processor directs electrical signals from the input to each of the plates that are not grounded wherein the other plates receive the signal and transmit the signal out of the manhole.

A frequency transmitting system for use in a manhole is also provided. The manhole includes a manhole opening covered by a manhole cover. The manhole opening includes an inner peripheral ledge. The frequency transmitting system includes a dish having a shell with a peripheral lip. The peripheral lip rests on the inner peripheral ledge of the manhole opening. The manhole cover rests on the peripheral lip of the dish.

The frequency transmitting system includes a plurality of transmitting plates. The transmitting plates are disposed on the peripheral lip of the shell. The transmitting plates are configured to transmit a signal at a predetermined frequency.

The frequency transmitting system further includes a ground out assembly. The ground out assembly includes a processor, a ground sensor, an input, and a wiring system. The wiring system electrically connects each of the transmitting plates to the input. The input is configured to receive an electrical signal wherein the ground sensor detects if a transmitting plate is grounded and the processor directs electrical signals from the input to each of the plates that are not grounded so as to allow the plates to transmit a signal from the input out of the manhole.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE PREFERRED EMBODIMENTS

A dish for use in a manhole having a manhole cover covering a manhole opening and a frequency transmitting system for use in a manhole are provided. The dish and the frequency transmitting system is configured to transmit a signal to a network outside of the manhole. The signal is generated by a sensor unit disposed within the manhole and configured to detect the conditions of the manhole.

The dish is seated underneath the manhole cover and includes a shell having a peripheral lip. The shell is generally bowl shaped. The dish includes a plurality of transmitting plates disposed on the peripheral lip. The transmitting plates are configured to transmit a signal having a predetermined frequency. The signal is generated by the sensor unit which may be configured to detect the presence of volatile gases or unauthorized tampering of the manhole cover. The sensor unit may be disposed within the manhole, beneath the manhole cover.

The dish includes a ground out assembly having a processor, a ground sensor, an input, and a wiring system. The input is configured to receive a signal from the sensor unit. The wiring system electrically connects each of the transmitting plates to the input. The input receives a signal from the sensor unit and transmits the signal to the wiring system. The ground sensor detects if a plate is grounded and transmits the status of the plates to the processor. The processor directs electrical signals from the input to each of the plates that are not grounded so as to transmit the signal from an outer edge of the transmitting plate. The transmitted signal reverberates within the space between the outer edge of the manhole cover and the inner wall of the manhole opening so as to generate an impedance. The impedance excites the metallic manhole cover which further facilitates the transmission of the signal.

Figure 1:
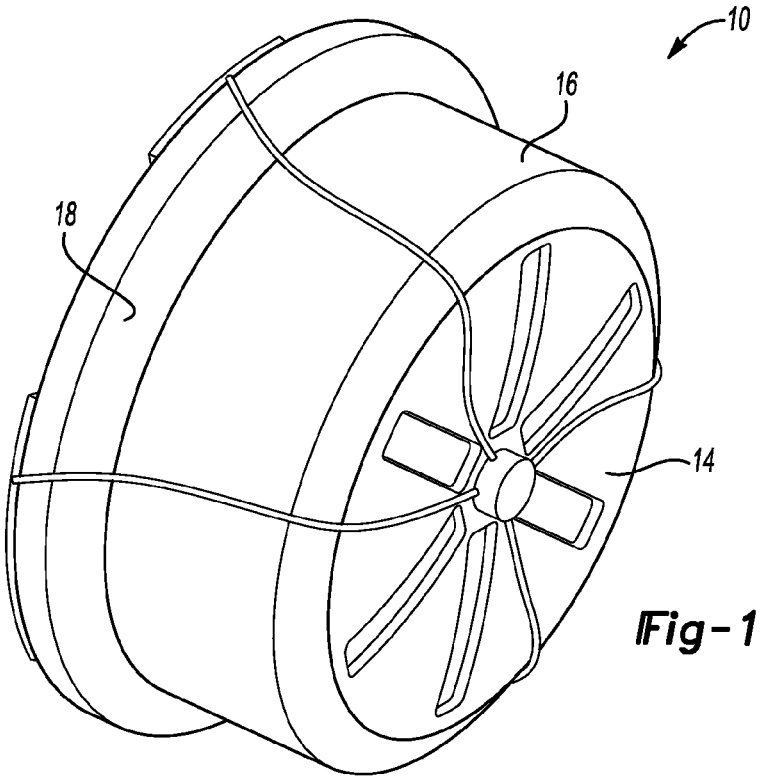
FIG. 1 is a perspective view of the transmitting dish.

With reference first to FIG. 1, a side view of the dish 10 is provided. The dish 10 includes a shell 12. The shell 12 has a floor portion 14 and a peripheral side wall 16. The peripheral side wall 16 extends along the circumferential edge of the floor portion 14. The distal end of the peripheral side wall 16 includes the peripheral lip 18 which extends radially from the circumferential edge of the peripheral side wall 16. The dish 10 is made of a non-electrically conductive material having sufficient rigidity to support itself in suspension such as polycarbonate or acrylic.

Figure 2:
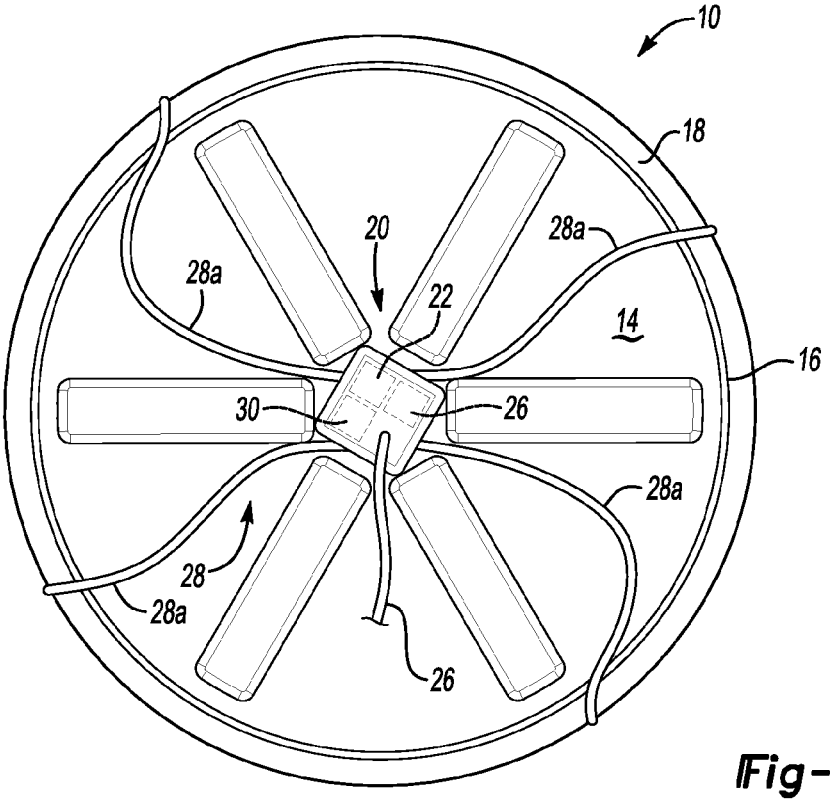
FIG. 2 is a top-down view of the dish shown in FIG. 1.

With reference now to FIG. 2, a top-down view of the dish 10 is provided. The dish 10 further includes a ground out assembly 20. The ground out assembly 20 includes a processor 22, a ground sensor 24, an input 26, and a wiring system 28. The wiring system 28 includes a plurality of electrically conductive wires 28*a*. Each of the wires 28*a* are electrically connected to the input 26. FIG. 2, shows four wires 28*a* extending from the input 26. However, it should be appreciated that wiring system 28 may include more or less wires 28*a*, and that the wires 28*a* may be embedded within the shell 12 itself.

The ground sensor 24 is configured to detect if any of the conductive wires 28*a* are grounded out. As used herein, the term grounded out refers to an electrical circuit completed by running the signal into the ground. Ground sensors 24 are known and used and illustratively include a voltmeter.

A gate system 30 such as a plurality of inductive switches are operatively connected to the wires 28*a* so as to direct a signal from the input 26 into a desired wire 28*a*. The gate system 30 receives a command from the processor 22 so as to determine which of the wires 28*a* are to receive a signal from the input 26. The processor 22 receives a signal from the ground sensor 24 so as to determine which of the wires 28*a* is grounded out. The processor 22 actuates the gate system 30 so as to allow a signal from the input 26 to be transmitted through the wires 28*a* which are not grounded out.

Figure 3:
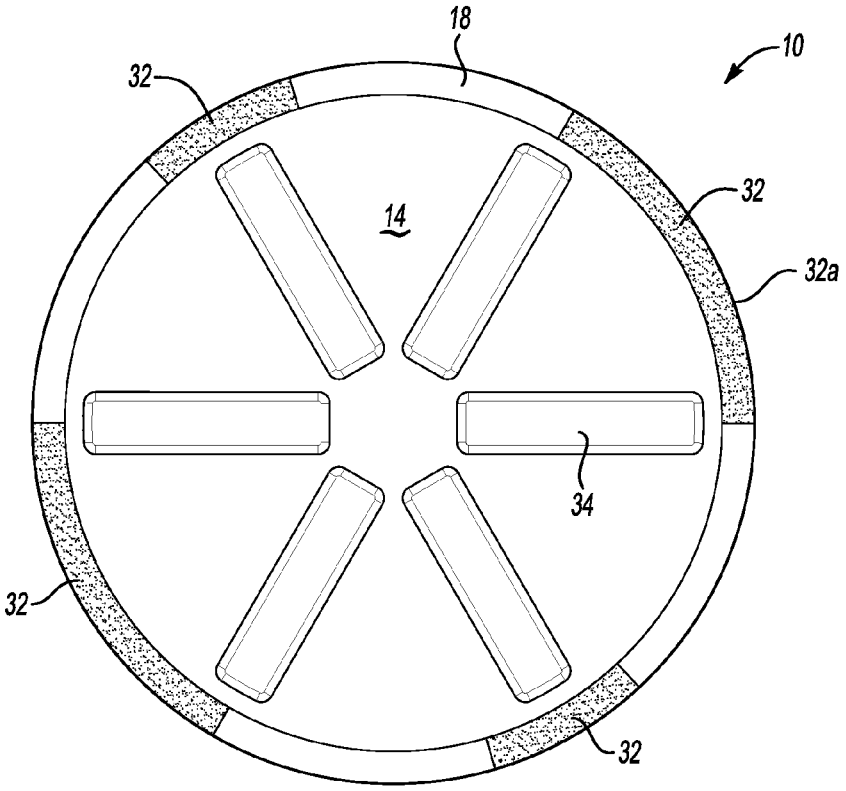
FIG. 3 is a view of FIG. 1 taken from the bottom showing the transmitting plates.

With reference now to FIG. 3, the dish 10 further includes a plurality of transmitting plates 32. FIG. 3 shows the transmitting plates 32 disposed on the peripheral lip 18. The transmitting plates 32 are shown having different physical dimensions. Specifically, FIG. 3 shows four transmitting plates 32, with one pair of transmitting plates 32 being generally longer in length than the other pair. The transmitting plates 32 are electrically coupled to a respective wire 28*a*. An outer edge 32*a* of the transmitting plates 32 is contiguous with the outer edge of the lip 18. Thus, the ground out assembly 20 is configured to transmit a signal from the input 26 to the transmitting plate 32 which is not grounded out, wherein the signal is transmitted along the outer edge 32*a* of the transmitting plate.

The inner surface of the shell 12 may include a strap (not shown). The strap is beneficial to facilitating the removal of the shell 12 for maintenance purposes. It is also shown that the shell 12 includes a plurality of elongated ribs 34. The ribs 34 extend radially from a central portion of the shell 12. The ribs 34 help provide structural stability so as to prevent the shell 12 from folding on itself.

With respect to the transmitting plates 32, it should be appreciated that the physical dimension of the plates 32 will create a different transmission frequency. Preferably, the transmitting plates 32 are formed of a material such as copper configured to transmit a signal. Preferably, the signal is transmitted at a frequency between 700 MHz to 1900 MHz.

Figure 4:
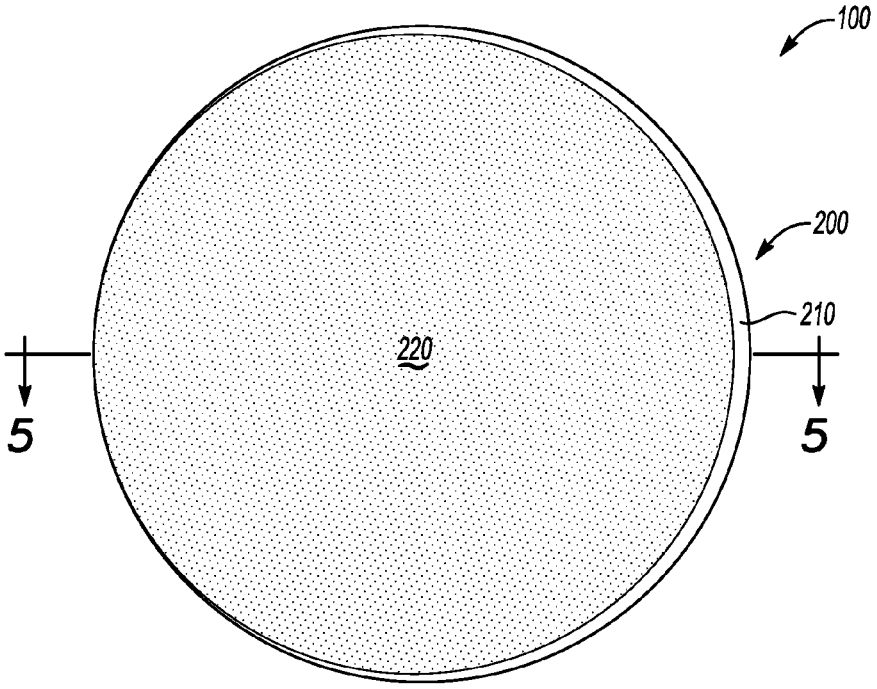
FIG. 4 is a top-down view of a manhole covered by a manhole cover.
Figure 5:
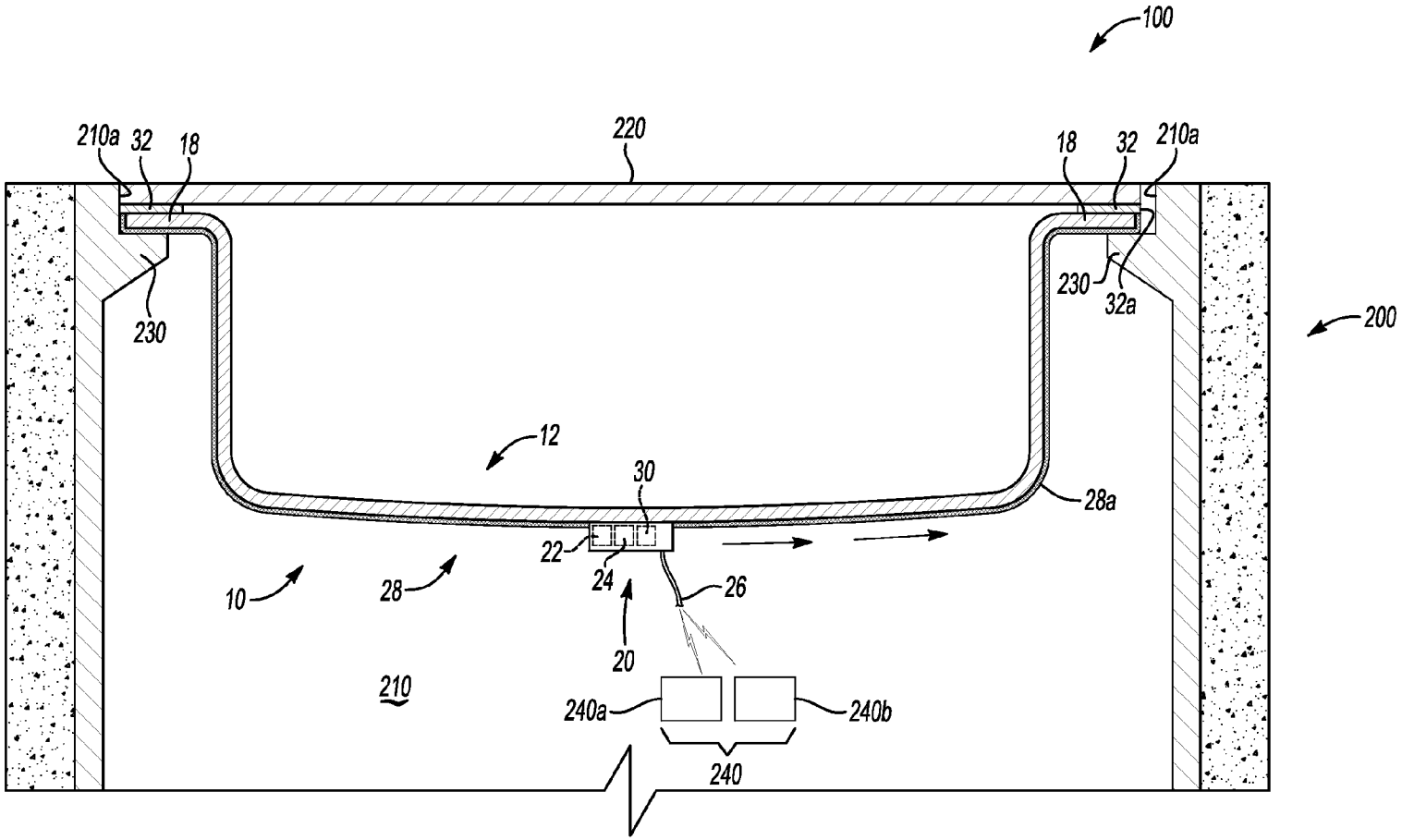
FIG. 5 is a cross-sectional view of FIG. 4 taken along lines 5-5.

With reference now to FIGS. 4 and 5, a frequency transmitting system 100 for use in a manhole 200 is provided. The manhole 200 includes a manhole opening 210 covered by a manhole cover 220. The manhole opening 210 includes an inner peripheral ledge 230. The inner peripheral ledge 230 supports the manhole cover 220. FIG. 4 provides a top down view of the manhole 200. As shown, the manhole cover 220 is slightly smaller than the manhole opening 210 which facilitates the removal of the manhole cover 220.

With reference now to FIG. 5, the frequency transmitting system 100 includes a dish 10. The dish 10 has a shell 12 with a peripheral lip 18. The peripheral lip 18 rests on the inner peripheral ledge 230 of the manhole opening 210. The frequency transmitting system 100 further includes a plurality of transmitting plates 32. The plates 32 are disposed on the peripheral lip 18 of the dish 10. The plates 32 are configured to transmit a signal at a predetermined frequency.

The ground out assembly 20 includes a processor 22, a ground sensor 24, an input 26, and a wiring system 28. The wiring system 28 includes a plurality of electrically conductive wires 28*a*. Each of the wires 28*a* are electrically connected to the input 26. FIG. 2, shows four wires 28*a* extending from the input 26. However, it should be appreciated that wiring system 28 may include more or less wires 28*a*, and that the wires 28*a* may be embedded within the shell 12 itself.

The ground sensor 24 is configured to detect if any of the conductive wires 28*a* are grounded out. As used herein, the term grounded out refers to an electrical circuit completed by running the signal into the ground. Ground sensors 24 are known and used and illustratively include voltmeter.

A gate system 30 such as a plurality of inductive switches are operatively connected to the wires 28*a* so as to direct a signal from the input 26 into a desired wire 28*a*. The gate system 30 receives a command from the processor 22 so as to determine which of the wires 28*a* are to receive a signal from the input 26. The processor 22 receives a signal from the ground sensor 24 so as to determine which of the wires 28*a* is grounded out. The processor 22 actuates the gate system 30 so as to allow a signal from the input 26 to be transmitted through the wires 28*a* which are not grounded out.

The frequency transmitting system 100 further includes a plurality of transmitting plates 32. The transmitting plates 32 disposed on the peripheral lip 18 of the dish 10. The transmitting plates 32 are electrically coupled to a respective wire 28*a*. Thus, the ground out assembly 20 is configured to transmit a signal from the input 26 to the transmitting plate 32 which is not grounded out.

The signal is generated by a sensor unit 240. Preferably, the sensor unit 240 includes at least two sensors. A first sensor 240*a* may be configured to detect the removal or movement of the manhole cover 220 and a second sensor 240*b* may be configured to detect the presence of a volatile or otherwise dangerous gas within the manhole 200. The first and second sensors 240*a*, 240*b* are connected to the input 26 so as to transmit a detection of either condition to the ground out assembly 20.

The frequency transmitting system 100 is configured to transmit a signal generated beneath the manhole cover 220. The dimension of the plates 32 are configured to generate a frequency adapted to be carried by a cellular network so as to allow a service provider to identify instances where the manhole cover 220 has been removed or a dangerous gas is present within the manhole 200. It should be further appreciated that the frequency emitted may be adjusted by tuning the physical dimensions of the transmitting plates 32. It should be further appreciated that the physical dimension of the transmitting plates 32 may also be adjusted based upon the power through which the signal is generated. For illustrative purposes the transmitting plates 32 are shown having two different lengths wherein the shorter one is configured to transmit at a frequency of generally 700 MHz and the larger of the transmitting plates 32 is configured to transmit at a frequency of 1900 MHz. The shell 12 is made of an electrically insulating material.

With reference again to FIG. 5, an explanation of the operation of the frequency transmitting system 100 is provided. The dish 10 is shown seated on the peripheral ledge 230 of the manhole opening 210 and the manhole cover 220 is shown mounted on the transmitting plates 32. For illustrative purposes the wire 28*a* is shown disposed external to the surface of the shell 12. However, it should be appreciated that the wire 28*a* may be embedded within the shell 12 itself. The wire 28*a* is in electrical communication with the plate. The plates 32 are exposed as the shell 12 is electrically insulating. The surface of the plates 32 needs to be exposed so as to transmit a signal. The manhole cover 220 is in physical contact with the transmitting plates 32.

Since the dimension of the manhole cover 220 is smaller than the manhole opening 210 itself, FIG. 5 shows one side of the manhole cover 220 and the dish 10 touching a peripheral wall of the manhole opening 210 and the other side of the manhole cover 220 and the dish 10 is free of the inner wall 210*a* of the manhole opening 210.

The ground out assembly 20 is shown disposed generally centrally located at the bottom of the dish 10 and the ground sensor 24 detects that the wire 28*a* and the plate 32*a* disposed along the left side of the image is in contact with the peripheral wall thus grounding out an electrical signal transmitted through said wire 28*a*. Thus, the ground sensor 24 communicates the ground out condition to the processor 22 and the processor 22 controls the gate system 30 so as to direct the electrical signal towards the wire 28*a* on the right where the plate 32*b* is not in contact with the peripheral wall and therefore not grounded out allowing the plate 32*b* to transmit a signal.

The signal is transmitted along the outer edge 32*a* of the transmitting plate 32. The transmitted signal reverberates within the space between the outer edge of the manhole cover 220 and the inner wall 210*a* of the manhole opening 210 so as to generate an impedance. The impedance excites the metallic manhole cover 220 which further facilitates the transmission of the signal.

The input 26 is configured to receive a signal from the sensor unit 240. For illustrative purposes the input 26 is shown as a wireless receiver. Any wireless receiver currently known and used in the art may be adapted for use herein, illustratively including a Bluetooth receiver or an antenna receiver. The input 26 is shown receiving a wireless signal from sensor unit 240*a* and 240*b* as indicated by the arrow. The first sensor 240*a* is configured to detect the removal of the manhole cover 220 and the second sensor 240*b* is configured to detect a condition of volatile gases. Alternatively, the input 26 may be electrically wired to the sensor unit 240. In such an embodiment, the input 26 may be a wire having a couple of leads to physically connect to the first and second sensor 240*a*, 240*b* and transmit the signals to the wiring system 28, via the gate system 30.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

I claim:

1. A dish for use in a manhole opening covered by a manhole cover, the dish seated underneath the manhole cover, the dish comprising:

a shell having a peripheral lip;

a plurality of transmitting plates disposed on the peripheral lip, the transmitting plates configured to transmit a signal at a predetermined frequency;

a ground out assembly having a processor, a ground sensor, an input and a wiring system, the wiring system electrically connected to each of the plurality of transmitting plates to the input, the input configured to receive an electrical signal, wherein the ground sensor detects if a plate is grounded, and the processor directs electrical signals from the input to each of the plurality of plates that are not grounded, and wherein each of the plurality of transmitting plates transmit the signal through the manhole cover.

2. The dish as set forth in claim 1, wherein the plurality of transmitting plates is a pair of transmitting plates, and wherein one of pair of transmitting plates is smaller than the others so as to transmit the signal at a different frequency than the other.

3. The dish as set forth in claim 1, wherein the plurality of transmitting plates are made of a material configured to transmit the signal having a frequency between 700 MHz and 1900 MHz.

4. The dish as set forth in claim 1, wherein the shell is made of an electrically insulating material.

5. The dish as set forth in claim 4, wherein the electrically insulating material is a polycarbonate.

6. A frequency transmitting system for use in a manhole, the manhole having a manhole opening covered by a manhole cover, the manhole opening including an inner peripheral ledge, the frequency transmitting system comprising:

a dish, the dish having a shell and a peripheral lip, the peripheral lip resting on the inner peripheral ledge of the manhole opening, the manhole cover resting on the peripheral lip of the dish;

a plurality of transmitting plates disposed on the peripheral lip, the plurality of transmitting plates configured to transmit a signal at a predetermined frequency;

a ground out assembly having a processor, a ground sensor, an input and a wiring system, the wiring system electrically connected to each of the plurality of transmitting to the input, the input configured to receive an electrical signal, wherein the ground sensor detects if a plate is grounded, and the processor directs electrical signals from the input to each of the plurality of plates that are not grounded, and wherein each of the plurality of plates transmit the signal through the manhole cover.

7. The frequency transmitting system as set forth in claim 6, wherein the plurality of transmitting plates is a pair of transmitting plates, and wherein one of the pair of transmitting plates is smaller than the others so as to transmit the signal at a different frequency than the other.

8. The frequency transmitting system as set forth in claim 6, wherein the plurality of transmitting plates are made of a material configured to transmit the signal having a frequency between 700 MHz and 1900 MHz.

9. The frequency transmitting system as set forth in claim 6, wherein the shell is made of an electrically insulating material.

10. The frequency transmitting system as set forth in claim 9, wherein the electrically insulating material is a polycarbonate.

* * * * *